US008863474B2

(12) United States Patent
Yuan

(10) Patent No.: US 8,863,474 B2
(45) Date of Patent: Oct. 21, 2014

(54) MAIN WORK CONSTRUCTION METHOD FOR REINFORCED CONCRETE BUILDING AND BUILDING CONSTRUCTION MACHINE

(76) Inventor: Bin Yuan, Suzhou (CN)

( * ) Notice: Subject to any disclaimer, the term of this patent is extended or adjusted under 35 U.S.C. 154(b) by 60 days.

(21) Appl. No.: 13/263,740

(22) PCT Filed: Apr. 9, 2010

(86) PCT No.: PCT/CN2010/000473

§ 371 (c)(1),
(2), (4) Date: Oct. 8, 2011

(87) PCT Pub. No.: WO2010/115350

PCT Pub. Date: Oct. 14, 2010

(65) Prior Publication Data

US 2012/0023840 A1 Feb. 2, 2012

(30) Foreign Application Priority Data

Apr. 10, 2009 (CN) ..... 2009 1 0116509

(51) Int. Cl.

| | |
|---|---|
| ***E02D 35/00*** | (2006.01) |
| ***E04G 21/14*** | (2006.01) |
| ***E04G 21/00*** | (2006.01) |
| ***B66F 7/20*** | (2006.01) |
| ***E04B 1/35*** | (2006.01) |

(52) U.S. Cl.

CPC .... *B66F 7/20* (2013.01); *E04B 1/35* (2013.01)
USPC ..... 52/745.2; 52/122.1

(58) Field of Classification Search

CPC ..... E04B 1/35; E04B 1/3511; E04B 1/3516; E04B 1/3522; E04B 1/3527; B66F 7/16; B66F 7/20
USPC ..... 52/122.1, 125.1, 126.1, 126.5, 236.3, 52/745.2; 405/230; 425/63
See application file for complete search history.

(56) References Cited

U.S. PATENT DOCUMENTS 3,017,723 A * 1/1962 Von Heidenstam ..... 52/236.6
3,179,374 A * 4/1965 Walli ..... 254/109

(Continued)

FOREIGN PATENT DOCUMENTS

CN JP9-296523 A 11/1997
CN 1423020 A 6/2003

(Continued)

OTHER PUBLICATIONS

English Translation of International Preliminary Report on Patentability for PCT/CN2010/000473 issued Oct. 11, 2011 (7 pages).*

(Continued)

*Primary Examiner* — Basil Katcheves
*Assistant Examiner* — Rodney Mintz
(74) *Attorney, Agent, or Firm* — IPro, Inc.; Na Xu

(57) ABSTRACT

A main work construction method for reinforced concrete building and a building construction machine are provided. The construction method involves constructing a top story framework on a lifting mechanisms (21) and a lifting platform (22); raising the top story framework by the lifting mechanisms (21); resetting the lifting platform (22) to an original position; constructing a second top story framework on the lifting mechanisms (21) and the lifting platform (22); permanently connecting the top story framework with the second top story framework; raising the top story framework and the second top story framework by the lifting mechanisms (21); and constructing repeatedly till the ground story framework is accomplished so as to complete the reverse story-by-story construction from the top story to the ground story.

8 Claims, 3 Drawing Sheets

(56) References Cited

U.S. PATENT DOCUMENTS

| | | | | | |
|---|---|---|---|---|---|
| 3,201,502 | A | * | 8/1965 | Pluckebaum | 264/34 |
| 3,210,903 | A | * | 10/1965 | Herolf | 52/745.13 |
| 3,239,990 | A | * | 3/1966 | Adler | 52/745.04 |
| 3,260,028 | A | * | 7/1966 | Lee | 52/745.04 |
| 3,275,719 | A | * | 9/1966 | Dudson | 264/33 |
| 3,355,853 | A | * | 12/1967 | Wallace | 52/745.13 |
| 3,362,126 | A | * | 1/1968 | Herolf | 52/745.13 |
| 3,363,393 | A | * | 1/1968 | Von Heidenstam | 52/745.13 |
| 3,552,080 | A | * | 1/1971 | Gretchenliev et al. | 52/745.13 |
| 3,579,935 | A | * | 5/1971 | Regan et al. | 52/125.1 |
| 3,594,965 | A | * | 7/1971 | Saether | 52/125.1 |
| 3,631,648 | A | * | 1/1972 | Filipek et al. | 52/745.03 |
| 3,692,446 | A | | 9/1972 | Vanderklaauw | |
| 3,722,169 | A | * | 3/1973 | Boehmig | 52/745.04 |
| 3,726,053 | A | * | 4/1973 | Filipek et al. | 52/123.1 |
| 3,793,702 | A | * | 2/1974 | Ahlgren | 29/426.3 |
| 3,828,513 | A | * | 8/1974 | Vanderklaauw | 52/745.04 |
| 3,831,902 | A | * | 8/1974 | Vanderklaauw | 254/105 |
| 3,892,055 | A | * | 7/1975 | Ljung | 52/745.1 |
| 3,920,780 | A | * | 11/1975 | Vanderklaauw | 264/33 |
| 3,921,362 | A | * | 11/1975 | Ortega | 52/745.14 |
| 3,974,618 | A | * | 8/1976 | Cortina | 52/745.14 |
| 4,251,974 | A | * | 2/1981 | Vanderklaauw | 52/745.2 |
| 4,455,270 | A | * | 6/1984 | O'Cadiz Castaneda | 264/33 |
| 5,022,199 | A | * | 6/1991 | Horii et al. | 52/123.1 |
| 5,088,263 | A | * | 2/1992 | Horii et al. | 52/745.13 |
| 5,319,895 | A | * | 6/1994 | Ray | 52/6 |
| 5,365,704 | A | * | 11/1994 | Ray | 52/64 |
| 5,575,591 | A | * | 11/1996 | Vanderklaauw | 405/230 |
| 5,761,855 | A | * | 6/1998 | Uang | 52/126.6 |
| 5,839,239 | A | * | 11/1998 | Jang | 52/123.1 |
| 5,970,680 | A | * | 10/1999 | Powers | 52/745.05 |
| 6,082,058 | A | * | 7/2000 | Deng | 52/125.1 |
| 6,260,311 | B1 | * | 7/2001 | Vladikovic | 52/122.1 |
| 7,818,942 | B2 | * | 10/2010 | Nakamitsu et al. | 52/745.01 |
| 8,544,238 | B2 | * | 10/2013 | Larouche et al. | 52/745.2 |
| 8,590,259 | B2 | * | 11/2013 | Trinko et al. | 52/741.15 |
| 8,745,956 | B2 | * | 6/2014 | Wang et al. | 52/741.1 |
| 2003/0079436 | A1 | * | 5/2003 | Manfre | 52/745.2 |
| 2008/0016805 | A1 | * | 1/2008 | Walter | 52/263 |
| 2011/0289862 | A1 | * | 12/2011 | Larouche et al. | 52/122.1 |
| 2013/0067832 | A1 | * | 3/2013 | Collins et al. | 52/125.1 |
| 2014/0017059 | A1 | * | 1/2014 | Wang et al. | 414/815 |

FOREIGN PATENT DOCUMENTS

| | | | |
|---|---|---|---|
| CN | 1903698 | A | 1/2007 |
| CN | 1987700 | A | 6/2007 |
| CN | 101538897 | A | 9/2009 |
| JP | 11-131811 | A | 5/1999 |

OTHER PUBLICATIONS

Cui Haibo, The International Searching Authority written comments, Jul. 2010, CN.

Yi Xu, The first office action, June, 2010, CN.

* cited by examiner

MAIN WORK CONSTRUCTION METHOD FOR REINFORCED CONCRETE BUILDING AND BUILDING CONSTRUCTION MACHINE

TECHNICAL FIELD

The present invention relates to a construction method for building, particularly to a main work construction method for reinforced concrete and prefabricated component building. The present invention also relates to one or more building construction units and a building construction machine related to the method.

BACKGROUND

The construction method for reinforced concrete building generally comprises in-situ casting construction method and prefabrication construction method. Many advanced technologies are developed for prefabrication construction in recent years. Although the prefabrication construction has higher level of mechanization and more obvious characteristic of industrial production than those of the in-situ casting construction, the integrity (such as shock resistance) of the prefabrication construction is affected, and the application of the prefabrication construction is limited because of the defects of poor reliability of dry nodal connection, etc. of the precast reinforced concrete construction. Most reinforced concrete building at present is constructed by the in-situ casting construction method. There is a big bottleneck to increase the industrialization level of the in-situ casting construction method, because all the existing in-situ casting constructions are completed story by story from the first story to the top story. After one story is constructed, all the facilities and equipment on the construction story must be moved to the next construction story to be assembled into the construction operation platform. How the facilities and equipment pass through the obstruction of the recently accomplished structure level is a problem to be faced; moreover, the difficulty increases with the extending of the high altitude. Therefore, using higher mechanized equipment on the constructing story becomes uneconomical and infeasible. In order for disassembly and assembly to be convenient, the traditional residential building construction facilities and equipments are very simple and light, including combined type scaffolds and tool type templates and the like in general. Such residential building construction facilities and equipments must result in low mechanization application level of residential building construction, much hand labor, hard operating condition, low labor productivity, difficult control of product quality, etc.

SUMMARY

In order to avoid the defects existing in the aforementioned prior art, the present invention provides a main work construction method for reinforced concrete building in accordance with the advantages of in-situ casting and prefabrication, so that the pipeline operation for industrial production can be formed on the construction site, to solve the problems of low mechanization level of prefabrication dry nodal connection and in-situ casting construction, high consumption of labor force, adverse labor condition, large fluctuation of the manual labor product quality, etc.

The main work construction method for reinforced concrete building of the present invention comprises the following steps: arranging lifting mechanisms and one or more lifting platforms on the surface layer of the completed permanent foundation; constructing a top story framework on said lifting mechanisms and said lifting platform; lifting the top story framework by said lifting mechanisms; constructing a second top story framework on the lifting mechanisms and the lifting platform, and permanently connecting the top story framework with the second top story framework; lifting said top story framework and said second top story framework by the lifting mechanisms; and constructing repeatedly till the ground story framework is accomplished so as to complete the reverse story-by-story construction from the top story to the ground story.

The present invention provides a main work construction method for reinforced concrete building, comprising the following steps:

a) arranging at least one lifting platform and multiple lifting mechanisms on the surface layer of the completed ground permanent foundation;

b) constructing a top story framework on said lifting mechanisms and said lifting platform;

c) lifting the top story framework by said lifting mechanisms;

d) supporting the lifted top story framework by supporting device(s), descending and resetting the lifting mechanisms to the original positions, constructing a second top story framework on the original lifting mechanisms and the lifting platform, and permanently connecting the top story framework with the second top story framework;

e) lifting said top story framework and said second top story framework by the lifting mechanisms;

repeating steps d) and e) to construct and lift all the stories under the second top story till the ground story framework is accomplished so as to complete the reverse story-by-story construction from the top story to the ground story.

In accordance with the present invention, the sequence of the reverse story-by-story construction comprises: a. arranging lifting mechanisms and one or more lifting platforms on the surface layer of the completed permanent foundation; b. constructing top story vertical structural members between said lifting mechanisms and the lifting platform, constructing a roof board on said lifting platform to form a top story framework; c. lifting the formed top story framework for one story by the lifting mechanisms by using the lifting platform as a support, and leaving the construction position of the second top story framework; d. constructing second top story vertical structural members among said lifting mechanisms, and permanently connecting the second top story vertical structural members with the top story vertical structural members; e. descending and resetting the lifting platform to the original position, and constructing a top story floor on the lifting platform to form a second top story framework; f. repeating the above steps c), d) and e) till the first story framework is accomplished on the first story vertical structural members; and g. anchoring the first story vertical structural members to the permanent foundation.

The method of the present invention is reversal of the order of the main work concrete construction and the traditional method. In the method, the top story is constructed first, and then other stories are constructed story-by-story from top to bottom to the first story. The problem that the equipment and turnover material on the work surface are assembled and disassembled, and assembled and disassembled again on each story is solved, so that the work surface is kept on the first story. Thus, the industrial assembly room can be formed by the mechanical equipment assembled in situ in the space of the first story. Therefore, the continuous construction of standard stories becomes possible, and the construction pipeline operation can be formed.

Compared with the prior art, the present invention has the following advantages.

1. All the standard stories above the permanent foundation are accomplished on the lifting platform of the assembly room arranged on the surface layer by story-by-story construction and line production by the present invention to form the pipeline operation, the mechanization level of construction operation and the standardization level of construction operation are greatly increased.

2. The construction equipment of the present invention is not repeatedly disassembled and assembled and is kept on the surface layer; the construction process is greatly simplified; the construction cost is reduced; and the construction speed is increased.

3. The building quality stability becomes better because the present invention uses the in-situ casting construction method in accordance with the prefabrication construction method.

4. The present invention enables the construction production to really achieve industrial production like the pipeline, solves the problem of building industrialization in the construction link and resolves the inconsistency between improvement of the construction machinery and equipment level and the economy; thus, various requirements of structure, function, decoration, etc. of the building are systematically considered in accordance with its inherent law, and are respectively integrated into various components; and substantial progress is made in the concrete implementation of the designs of in situ integrating and assembling the system integration products provided by various professional factories.

In addition, the present invention further provides a building construction machine. Said building construction machine is positioned on the ground and comprises: at least one building construction unit, wherein each building construction unit comprises a lifting platform and multiple lifting mechanisms installed and fixed under the lifting platform; and said at least one building construction unit cooperatively operates and simultaneously lifts the framework of the same story of the building to be constructed; and a lifting control system, wherein said lifting control system comprises one or multiple hydraulic servo pump stations, multiple displacement detecting devices, multiple jack load measuring devices, multiple electric control substations and a main control electric system, and controls the lifting mechanisms of said at least one building construction unit in accordance with groups and loops to achieve simultaneous lifting.

The building construction machine of the present invention changes the story-by-story construction from the ground story to the top story of the traditional building construction method into the reverse story-by-story construction from the top story to the ground story. The building construction machine is designed for constructing residential building industrial products instead of constructing residential building handicrafts, and the constructed residential building has the standardized variety like the cars produced on the pipeline. Thus, large scale production and industrialization are achieved. Namely the residential building is divided into high-rise residential building and small high-rise residential building; the stories are various and all stories are of the same structure. The standardized stories occur. The construction facilities and equipment of the building construction machine of the present invention are not assembled and disassembled during construction on each story. Thus, the construction facilities and equipment for residential building have more mechanization and electrification applications. The building construction machine of the present invention serves the reverse construction method so as to achieve the aims that the building construction machine is assembled once and is used by the whole building, and the facilities of the building construction machine always operate on the ground story. After one story is constructed, the equipment is integrally placed without passing through the structure level as long as the equipment is lifted for one story and is reset to the original position, and the procedures of disassembly, conveying, assembly, etc. are omitted. The building construction machine of the present invention is corresponding to a floating building assembly room. The building construction machine comprises traveling condition and producing condition. When the building construction machine is in traveling condition, all the hydraulic parts, central control systems and trusses are contracted, gathered together and fixed on several motorcar chassis in accordance with areas so as to respectively and conveniently travel. After traveling and being placed, all parts are reformed and assembled into the producing condition: the support devices are placed, the hydraulic parts are placed and the trusses are placed and fixed, and the mechanical system and the electric system are assembled and commissioned to form an assembly room having high level of mechanization and electrification application, a load platform, an in-situ casting platform and a lifting platform.

In summary, compared with the existing small-size machine for sequential story construction and hand work, the building construction machine of the present invention has the following advantages.

1. The mechanization and electrification levels are greatly improved and the efficiency is increased by using the large-size hydraulic and central control systems.

2. The hand work is reduced, and the operating condition is improved.

3. The building construction machine is assembled once and is used by the whole building; many procedures of assembly and disassembly are reduced; the construction period is shortened; and the cost is saved.

4. The parts are used in large scale, and the industrial level is increased.

5. The product quality is guaranteed because of mechanization and standardization production, and convenience is provided for management.

BRIEF DESCRIPTION OF FIGURES

When reading in accordance with the figures, the essence, principle and practicality of the present invention become more obviously by the following detailed description, wherein the same components in the figures are marked by the same figure marks.

The invention will further be described in detail in accordance with the figures and the preferred embodiments.

DETAILED DESCRIPTION

Figure 1:
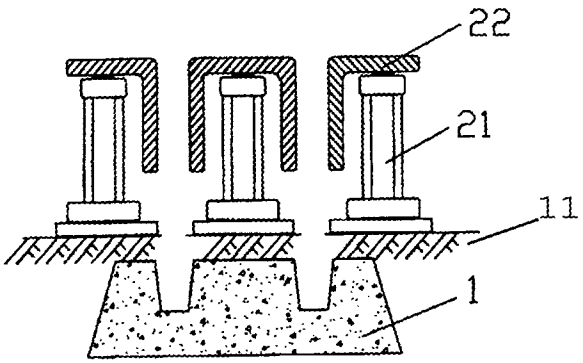
FIG. 1, FIG. 2, FIG. 3, FIG. 4, FIG. 5, FIG. 6 and FIG. 7 are the schematic diagrams of the construction process of the top story and the second top story of the present invention.

As shown in FIG. 1, an assembly room is arranged on the level ground of the surface layer of the completed permanent foundation 1; the assembly room is required to include the lifting platform 22 capable of bearing the construction loads of the whole building and the lifting mechanisms 21 having reciprocating motion.

One embodiment of the present invention comprises the construction steps.

Figure 2:
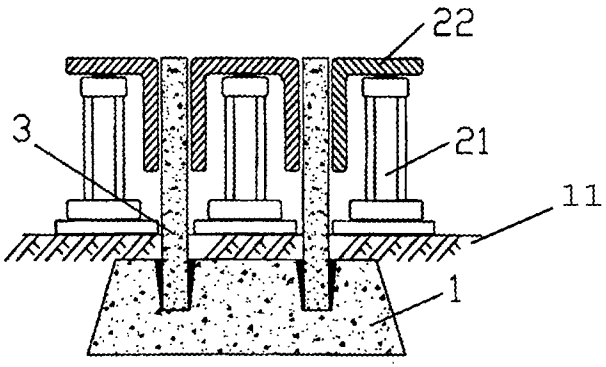
Figure 3:
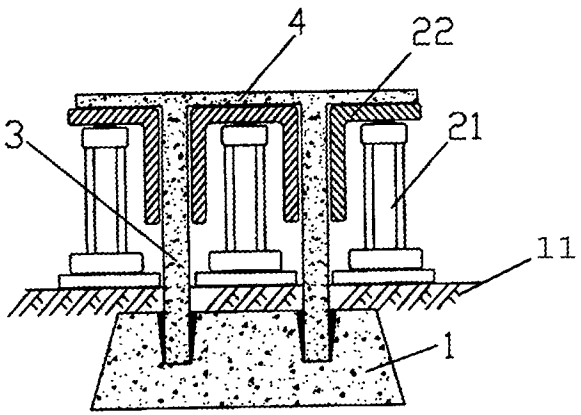
Figure 4:
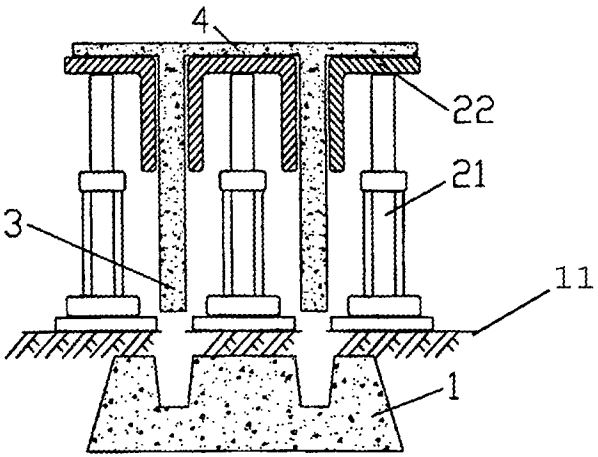
Figure 7:
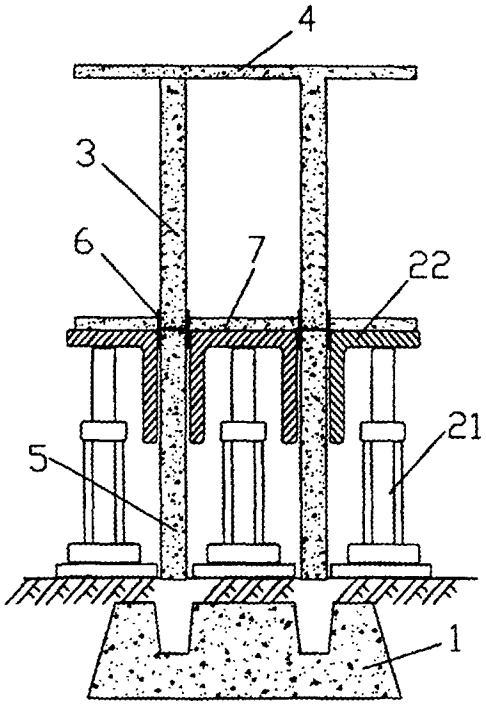
Figure 6:
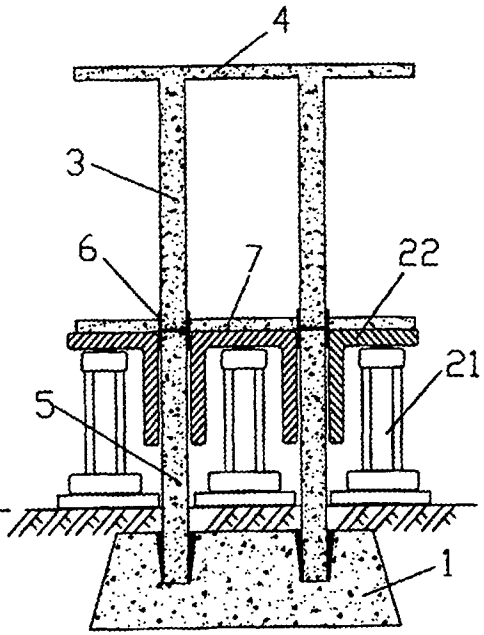
Figure 5:
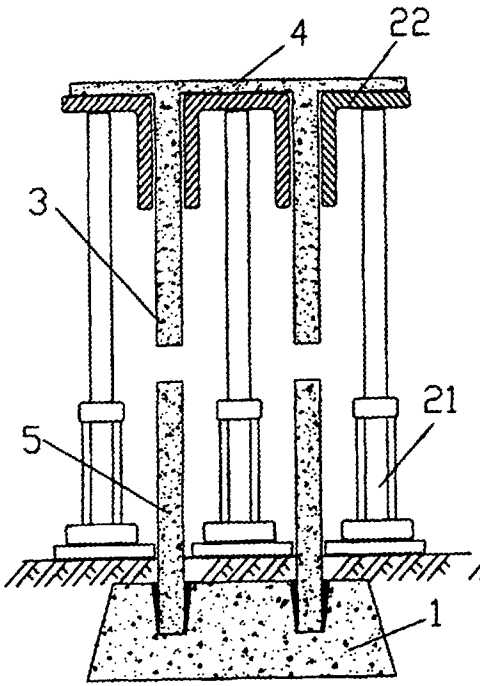

1. arranging the assembly room, including the lifting mechanisms 21 and the lifting platform 22, on the surface layer 11 of the completed permanent foundation 1, as shown in FIG. 1;
2. constructing top story vertical structural members 3 between said lifting mechanisms 21 and the lifting platform 22, temporarily connecting the top story vertical structural members 3 with the lifting platform 22, and the top story vertical structural members 3 may be columns or shear walls, as shown in FIG. 2;
3. constructing a roof board 4 on the lifting platform to form a top story framework, as shown in FIG. 3;
4. lifting the formed top story framework for one story by the lifting mechanisms 21 by using the lifting platform as a support, and leaving the construction position of the second top story framework, as shown in FIG. 4;
5. constructing second top story vertical structural members 5 among the lifting mechanisms 21, as shown in FIG. 5;
6. vertically connecting the second top story vertical structural members 5 with the top story vertical structural members 3 by section steel 6 for reinforcement to form a load integration so as to bear the vertical load of the building, as shown in FIG. 6; disconnecting the top story vertical structural members 3 from the lifting platform 22 so that the top story vertical structural members 3 and the second top story vertical structural members 5 independently bear load; reversely operating the lifting mechanisms 21 so that the lifting platform 22 is descended and reset to the original position; temporarily connecting the lifting platform 22 with the second top story vertical structural members 5 for reinforcement, and then constructing a top story floor 7 on the lifting platform 22 to form the second top story framework;
7. repeating the above steps 4 to 6 till the first story framework is accomplished on the first story vertical structural members, as shown in FIG. 7;
8. anchoring the first story vertical structural members to the permanent foundation.

In the specific embodiment, the existing computer monitoring software and hardware system and the hydraulic lifting equipment of a large tonnage are used, such as a large-load hydraulic lifting mechanism able to be mechanically locked at any position, patent number 2004100111228; the hydraulic lifting mechanism is controlled by the computer for inducting, monitoring and controlling the movement and is provided with a misoperation safety locking mechanism.

In the method of the present invention, the manufacturing shop is formed on the ground story, flow production is performed so that the industrial production of construction can be performed in accordance with the flow production, various requirements of structure, function, decoration, etc. of the building are systematically considered in accordance with its inherent law and are respectively integrated into various components, and the components are prefabricated in the factory and are directly transported to the in-situ asseroomly room to be assembled. For example, the functions including external decoration, water resistance, heat preservation, sound insulation, maintenance, etc. are integrated into the external wall components; the functions including water supply, power supply, water resistance, cupboard, etc. are integrated into the kitchen and toilet components; the functions including separation, sound insulation, etc. are integrated into the internal wall components; and all components are accurately prefabricated in high quality in the factory, transported to the in-situ asseroomly room and assembled into the building in the fixed position.

In the specific embodiment, the corresponding installation comprises.

1. Safety and economy of the lifting platform. The integrity and the rigidity of the lifting platform ensure that the schemes are safely and successfully implemented; because the problem that the equipment and turnover material on the work surface are assembled and disassembled, and assembled and disassembled again on each story is solved, the lifting platform is assembled once and is used for many times, the input cost is amortized for many times so that good economy is obtained.
2. The controllability of the movement of the lifting platform. The lifting platform is set to only move in the upward direction in the lifting process to obtain the one-way locking; when there is a problem in partial lifting platform, the whole lifting platform can not be lifted by local locking; the speeds and strokes of all the hydraulic lifting mechanisms shall be consonant to perform stroke locking.
3. Prefabricated vertical structural members. Vertical structural members are structural members bearing building loads during construction, are designed in accordance with the principle of combining permanence with temporariness by considering the temporary support intensity and rigidity, and the integrity of permanent connection.
5. The connection of the lifting platform and the vertical structural members. Because the building loads are transmitted to the permanent foundation of the building by the lifting platform and the vertical structural members during construction, facilities should be preserved on the permanent foundation in order to bear the loads transmitted by the lifting platform and the vertical structural members; meanwhile, the lifting platform and the vertical structural members are provided with facilities for convenient connection and disconnection in order to conveniently transmit loads and bear loads jointly, to ensure the whole lifting stability.
6. Prefabrication and in-situ casting. All the prefabricated structural members of the present invention are integrally connected and combined by in-situ casting.

Figure 8:
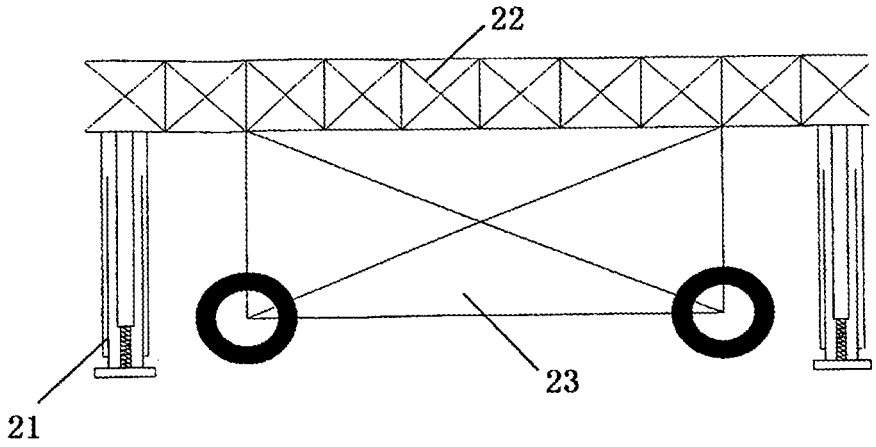
FIG. 8 is a sectional view, showing a building construction unit of one embodiment of the present invention corresponding to the aforementioned construction method.

FIG. 8 is a sectional view, showing a building construction unit of one embodiment of the present invention corresponding to the aforementioned construction method. As shown in FIG. 8, the building construction unit comprises a lifting platform 22 and lifting mechanisms 21 fixed under the lifting platform 22. Said lifting platform 22 can use a steel structure system. Said steel structure system comprises vertical and horizontal truss steel girders, arranged correspondingly to the vertical and horizontal truss steel girders of the building structure to be constructed. Said lifting platform and said lifting mechanisms form a load bearing structure, and the load bearing structure is temporarily anchored to the permanent structure column to form the load integration.

Figure 9:
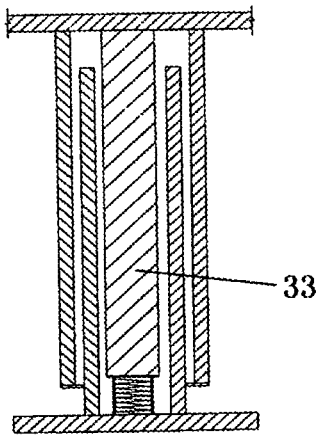
FIG. 9 is a sectional view, showing the telescopic sleeve and the jack of one lifting mechanism.

Each said lifting mechanism 21 comprises a jack 33. Said lifting mechanism 21 can also comprise at least one telescopic sleeve, and the inner cylinder and the outer cylinder of said telescopic sleeve can be mutually locked so as to bear certain load when required to play the function of safety guard. Of course, the lifting mechanism may not be provided with said telescopic sleeve, and the lifting operation can be achieved by using the jack only. In the embodiment shown in FIG. 9, each said telescopic sleeve can comprise an upper outer cylinder and a lower inner cylinder, and the lower inner cylinder is temporarily anchored to the permanent structural column. The jack 33 is positioned in said telescopic sleeve, and the base of the jack is fixed on said lower inner cylinder. The upper outer cylinder is a steel cylinder, the lower inner cylinder is also a steel cylinder, and the upper outer cylinder and the jack can respectively climb relative to the accessory wall of said lower inner cylinder so that the lifting platform is lifted to the preset height.

As shown in FIG. 8, said building construction unit can also comprise a traveling gear 23, such as motorcar chassis, so that said building construction unit can be changed to traveling condition from constructing condition conveniently.

In the practical construction, take the residential building standard unit as an example, considering the requirement of convenient construction and the requirement of freely division to meet residence function, the beam-column layout for residential building structures should be preferably designed. The load distribution of loading is determined, and the whole construction plane is divided in accordance with the beam-column layout. In accordance with the division, multiple building construction units are placed. In addition, crane beams for transporting materials and feeding pipelines can be arranged between adjacent building construction units.

The building construction machine of the present invention comprises at least one the aforementioned building construction unit. In order to cooperatively control multiple lifting mechanisms of the building construction unit during building construction, the building construction machine of the present invention also comprises a lifting control system. Said lifting control system comprise one or multiple hydraulic servo pump stations, multiple displacement detecting devices, multiple jack load measuring devices, multiple electric control substations and a main control electric system.

The jacks of said at least one building construction unit are grouped and looped so that said lifting control system can control these jacks through groups and loops, to achieve the synchronous lifting of the jacks. Preferably, each hydraulic servo pump station is arranged corresponding to each building construction unit. Each hydraulic servo pump station comprises multiple hydraulic pumps, and each hydraulic pump supplies hydraulic fluid to one or multiple jacks.

Each displacement detecting device comprises a displacement sensor for measuring the lifting displacement of each jack in time, and transmitting the corresponding displacement electrical signal to the electric control substation.

Each jack load measuring device comprises a pressure sensor, and the hydraulic fluid pressure of the hydraulic cylinder can be accurately measured by the pressure sensor so that the accurate tonnage of the load can be obtained.

Optionally, the present invention controls the hydraulic pumps through the frequency control motor and changes the motor speed by regulating the power supply frequency to achieve the purpose of continuously regulating the flow of the hydraulic pumps, and is matched with the appropriate electric control and detection feedback system to form the close loop control of the pressure and displacement so as to accurately control the synchronization of all hydraulic cylinders during lifting and the load balance during weighing.

Preferably, the hydraulic pumps of the present invention are piston pumps with flow valve. The pump station can be provided with a balance valve to reliably ensure that the hydraulic cylinder is in control of the feeding speed when the hydraulic cylinder is lifted or descended, so as to avoid the influence of the system on the load structure because of pressure impact during up-down switching. Meanwhile, the valve can lock the hydraulic cylinder without leakage, and can ensure that the hydraulic cylinder will not freely slide downwards in the case of sudden blackout, so that the load bear bore by the hydraulic cylinder will not be in the condition of out of control. In addition, the control valve has the function of unloading during overloading.

The electric control substations can send control signals to the corresponding hydraulic servo pump stations to control the lifting of the corresponding lifting mechanisms.

The main control electric system cooperatively controls multiple electric control substations to control the production of the whole building construction machine.

The commissioning and calibration of the lifting mechanisms will be described in detail.

Step 1: Determining the load distribution of loading, and placing the jacks in accordance with load distribution; wherein, determining the rough distribution figure of loading in accordance with load area, and dividing the whole building; placing the jacks, and fixing the jacks on the bearing structure system of the equipment; placing displacement sensors on partial or all jacks selectively. Preferably, placing the displacement detecting devices at four points on the jacks positioned at four corners of the load; and placing the electric control substations and the main control electric system, and establishing bus communications.

Step 2: Putting a commissioning heavy object on the lifting platform, preloading the lifting mechanisms, and determining the whole construction height datum. Because the datum of the ground is inconsistent with that of the load bearing base, before each lifting, the integral datum should be determined and established. The preload of each jack is set in accordance with the estimated distribution situation of the total load. The hydraulic servo pump station is started, and the jacks are preloaded in accordance with the set preload of each jack. When the preset preload is achieved, the hydraulic servo pump station is controlled to stop supplying hydraulic fluid to each jack. Thus, the integral datum is found and established.

The commissioning heavy object is weighed when doing the above step 2. The load is simultaneously lifted for a certain distance, such as 4 mm (0.15 inch). The gravity centre of load and the load distribution are calculated in accordance with the jack load data of the jack load measuring devices to prepare for the next whole lifting.

When performing lifting operation during construction, preferably, the jacks are controlled to lift several times. For example, the lifting distance of each time is 120 mm (4.72 inch); the bearing structure system platform of the equipment immediately climbs with each lifting to achieve cooperative operation; and the jacks perform lifting operation again and repeat the lifting operation until the total height of one story of the building in total is achieved, such as 3 m. In the process that the load is lifted 120 mm (4.72 inch), the position error of the measuring point during the overall lifting process does not exceed 0.25 mm (0.0098 inch). Once the position error exceeds 0.25 mm (0.0098 inch) or the pressure error of any hydraulic cylinder exceeds 5%, immediately close the system to ensure load safety. Repeat the lifting operation many times until the load is lifted 3 m (118.11 inch).

During lifting, the pressure sensor and the displacement sensor of each hydraulic cylinder transmit the load and displacement signals to the programmable controller. The frequency converter unit is driven in accordance with the operating instruction sent by the control console to output hydraulic fluid so that the corresponding hydraulic cylinder moves. The programmable controller continuously corrects the movement error in accordance with the detected pressure and displacement signals to keep the synchronized and balanced load of each cylinder. For example, the core control devices can be the Siemens S7-300 series. One industrial computer is connected with the PROFIBUS industrial bus through a PC interface to monitor and display all the loaded parameters of the lifting cylinders and record the overall lifting process. The PROFIBUS bus is also hung with multiple subsystems, and all the subsystems are composed of CPU S7-200. All the subsystems are controlled by S7-300 so that cooperation is obtained. Because the industrial bus mechanism is used, the system reliability is very high. The system can ensure the safety of data and engineering even in the case of sudden power failure because the system reliability is provided with a UPS power supply.

The skilled technical personnel of the technical field should understand that they can make various modifications, combinations, sub-combinations and replacements in accordance with design requirement and other factors, and all of which should be considered to belong to the scope of the claims or its equivalent scope.

I claim:

1. A main work construction method for reinforced concrete building comprises the following steps:

a) arranging at least one lifting platform and multiple lifting mechanisms on a surface layer of a permanent foundation;

b) constructing a top story framework on said lifting mechanisms and said lifting platform, wherein constructing the top story framework comprises constructing a roof board directly on said lifting platform;

c) lifting the top story framework by said lifting mechanisms off the surface layer of the permanent foundation;

d) supporting the lifted top story framework by supporting devices, descending and resetting the lifting mechanisms to the surface layer of the permanent foundation, constructing a second top story framework on the lifting mechanisms and the lifting platform, and permanently connecting the top story framework with the second top story framework; wherein the second top story framework is positioned below the top story framework;

e) lifting said top story framework and said second top story framework by the lifting mechanisms off the permanent foundation;

wherein the lifting mechanisms and the lifting platform are commissioned and calibrated between step a) and step b), and said commissioning and calibration comprise the following steps:

putting a commissioning heavy object on the lifting platform, preloading the lifting mechanisms, determining a whole construction height datum, weighing the commissioning heavy object, calculating a gravity center of load formed by the commissioning heavy object and the lifting platform and a load distribution, and preparing for lifting operation during construction;

wherein lifting the top story framework by said lifting mechanisms off the surface layer of the permanent foundation comprises lifting the lifting platform by said lifting mechanisms off the surface layer of the permanent foundation.

2. The main work construction method for reinforced concrete building of claim 1, wherein at least one of the said lifting mechanisms comprises a jack.

3. The main work construction method for reinforced concrete building of claim 1, wherein the lifting platform is not removed while descending and resetting the lifting mechanisms to the surface layer of the permanent foundation.

4. The main work construction method for reinforced concrete building of claim 1, wherein said step b) further comprises the steps of: constructing top story vertical structural members among said lifting mechanisms and the lifting platform;

wherein said step c) comprises the steps of: lifting the top story framework by one story;

wherein said step d) comprises the steps of: constructing second top story vertical structural members among said lifting mechanisms, using the second top story vertical structural members as said supporting devices, and permanently connecting the second top story vertical structural members with the top story vertical structural members, and constructing a top story floor on the lifting platform;

wherein said method also comprises: anchoring a lowest story framework to the permanent foundation.

5. The main work construction method for reinforced concrete building of claim 1, wherein said step a) also comprises the steps of: determining a building load distribution, and placing the lifting mechanisms and the lifting platform in different areas in accordance with the building load distribution.

6. The main work construction method for reinforced concrete building of claim 1, wherein in step c) and step e), the lifting mechanisms are controlled to lift several times.

7. The main work construction method for reinforced concrete building of claim 1, wherein a lifting distance of the lifting mechanisms in step c) and e) is 120 mm (4.724 inches).

8. The main work construction method for reinforced concrete building of claim 1, wherein a position error for determining a position of the lifting mechanisms in step c) and e) during each lifting does not exceed 0.25 mm (0.0098 inch); once the position error exceeds 0.25 mm (0.0098 inch) or a pressure error of a hydraulic cylinder of any lifting mechanism exceeds 5%, immediately stop lifting to ensure safety.

* * * * *